US005137181A

United States Patent [19]

Keller

[11] Patent Number: 5,137,181

[45] Date of Patent: Aug. 11, 1992

[54] MANUALLY OPERATED APPLIANCE, IN PARTICULAR FOR A DOUBLE DISPENSING CARTRIDGE FOR TWO-COMPONENT SUBSTANCES

[75] Inventor: Wilhelm A. Keller, Rebenweg 5, CH-6331 Hünenberg, Switzerland

[73] Assignee: Wilhelm A. Keller, Switzerland

[21] Appl. No.: 554,266

[22] Filed: Jul. 18, 1990

[51] Int. Cl.[5] ..... B05C 17/01

[52] U.S. Cl. ..... 222/134; 222/137; 222/145; 222/327

[58] Field of Search ..... 222/134, 135, 137, 145, 222/287, 325-327, 386, 391

[56] References Cited

U.S. PATENT DOCUMENTS

| | | | |
|---|---|---|---|
| 2,233,587 | 3/1941 | Crewe | 222/391 X |
| 2,732,102 | 1/1956 | Ekins | 222/391 X |
| 3,117,696 | 1/1964 | Herman et al. | 222/137 |
| 3,311,265 | 3/1967 | Creighton, Jr. et al. | 222/137 |
| 3,568,885 | 3/1971 | Spencer | 222/137 X |
| 4,033,484 | 7/1977 | Ornsteen | 222/391 X |
| 4,452,285 | 6/1984 | Leibhard et al. | 222/391 X |
| 4,471,888 | 9/1984 | Herb et al. | 222/391 X |
| 4,566,610 | 1/1986 | Herb | 222/391 X |
| 4,840,294 | 6/1989 | Ernst | 222/391 X |
| 4,869,400 | 9/1989 | Jacobs | 222/391 X |

FOREIGN PATENT DOCUMENTS

| | | | |
|---|---|---|---|
| 0245198 | 5/1963 | Australia | 222/391 |
| 0276665 | 8/1988 | European Pat. Off. . | |
| 3128611 | 1/1983 | Fed. Rep. of Germany . | |
| 2532862 | 3/1984 | France . | |
| 0130835 | 2/1951 | Sweden | 222/391 |
| 2065233 | 6/1981 | United Kingdom . | |
| 87/04644 | 8/1987 | World Int. Prop. O. | 222/391 |

*Primary Examiner*—Michael S. Huppert
*Assistant Examiner*—Edward M. Wacyra
*Attorney, Agent, or Firm*—Ostrolenk, Faber, Gerb & Soffen

[57] ABSTRACT

A manually operated appliance, particularly adapted for a two-component substance double dispensing cartridge, features two rams between which a thrust member is disposed in cylindrical sliding guides. Pivotably attached to the thrust member are ratchets, the pawls of which engage with an indentation extending on either side of each ram in order to move the rams, including the thrust pieces, in the direction of the cartridges. A thus guided thrust member, which is essentially movable only in parallel to the rams, provides for perfect force transmission and exact proportioning even when relatively great pressures occur and different diameters of the individual component cartridges are used.

22 Claims, 8 Drawing Sheets

161
162
159a
159b
160
169
170
177
178
155
172
175
168
171
174
179
176
180
XVII
XVIII
167
166
185
184
183
165
164
182
159
158
156
157
a
181
7a
7b
4
4a
4b

MANUALLY OPERATED APPLIANCE, IN PARTICULAR FOR A DOUBLE DISPENSING CARTRIDGE FOR TWO-COMPONENT SUBSTANCES

BACKGROUND OF THE INVENTION

The present invention refers to a manually operated appliance, in particular for a double dispensing cartridge for two-component substances, having a respective thrust ram for each cartridge and an advance drive jointly acting onto the thrust rams which is actuated by means of a hand lever. Such a manually operated appliance is known German Offenlegungsschrift no. 3 128 611, wherein each thrust ram is actuated, by means of a hand lever, by a respective clamping jaw and via a bail, a thrust bearing being provided for lateral support of the thrust rams, on which the clamping jaws are pivotably beared. In spite of the fact that the drive works directly onto each ram, the clamping jaws act onto the rams laterally with a resulting tendency to bend them even when thrust bearings are provided. Hence, there is a risk that the drive is jammed when great forces are applied.

SUMMARY OF THE INVENTION

In contrast, it is the object of the present invention to provide a manually operated appliance the advance of which, each time a force is applied, acts onto the rams in such a manner that any bending and canting and, hence, any jamming of the same is rendered impossible, and that the required force for operation is reduced. Further, the appliance is to be operable in connection with double dispensing cartridges having each a different diameter while even under those conditions where different reaction forces upon the rams result, the rams must be advanced in synchronism in order to prevent any variation of the mixing ratios. These objects are attained by a manually operated appliance wherein the advance drive is provided with a thrust member sliding in guides, which essentially acts onto the rams only in the direction of the rams. In the different embodiments, both proportioning and force transmission from the hand lever to the rams are improved.

BRIEF DESCRIPTION OF THE DRAWINGS

The invention is explained in detail hereinafter with reference to a drawing of embodiments.

DETAILED DESCRIPTION OF THE DRAWINGS

Figures 1, 5, 6:
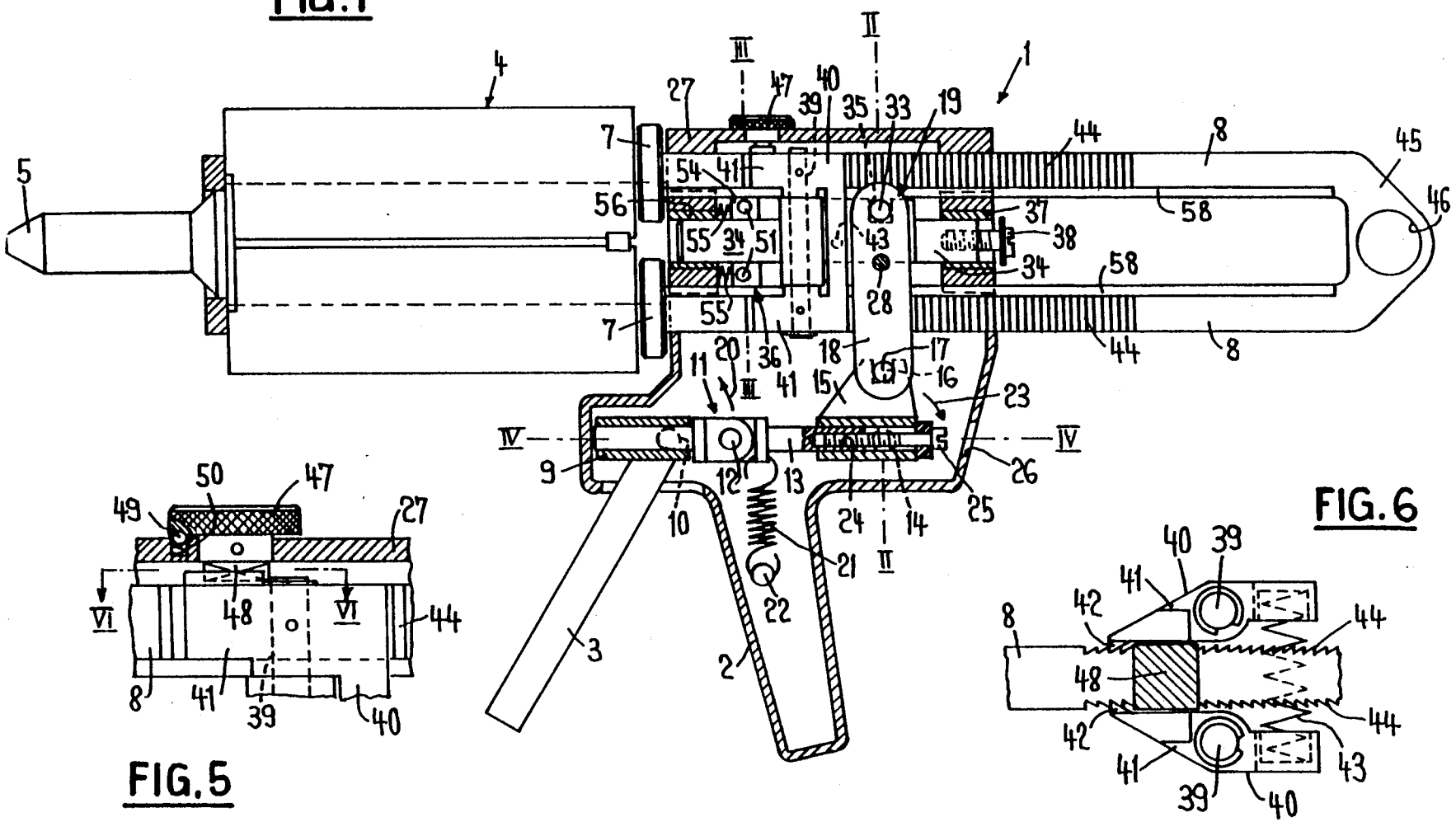
FIG. 1 shows in a cutaway view a first embodiment of the manually operated appliance according to the invention.
FIG. 5 shows an enlarged detail of the upper portion of the appliance of FIG. 1.
FIG. 6 shows a plan view of FIG. 5 according to line VI/VI.

FIG. 1 shows a first embodiment of a manually operated appliance 1 having a handle 2, the trigger 3, as well as the double cartridge 4 which holds two components in a determined ratio which are mixed in a so-called interposed static mixer whereupon they chemically react and harden or solidify, respectively. Dispensing of the two components from the cylinders should thereby take place by simultaneous actuation of dispensing pistons disposed in each cylinder, the substances being thus extruded from the front nozzle 5 of the static mixer. The double cartridge 4 is not in itself an object of the present invention, and it has been described exhaustively e.g. in the European Patent Application no. 294 672 of the same applicant. The manually operated appliance of the invention, however, is not restricted to the operation of such double cartridges, but it is particularly suitable therefor.

Figure 4:
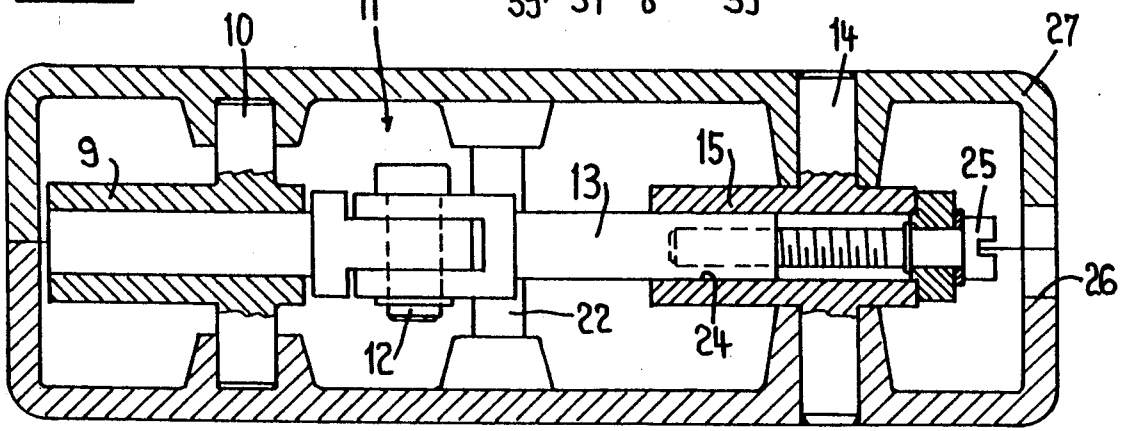
FIG. 4 shows a section along the line IV/IV of FIG. 1.
Figure 2:
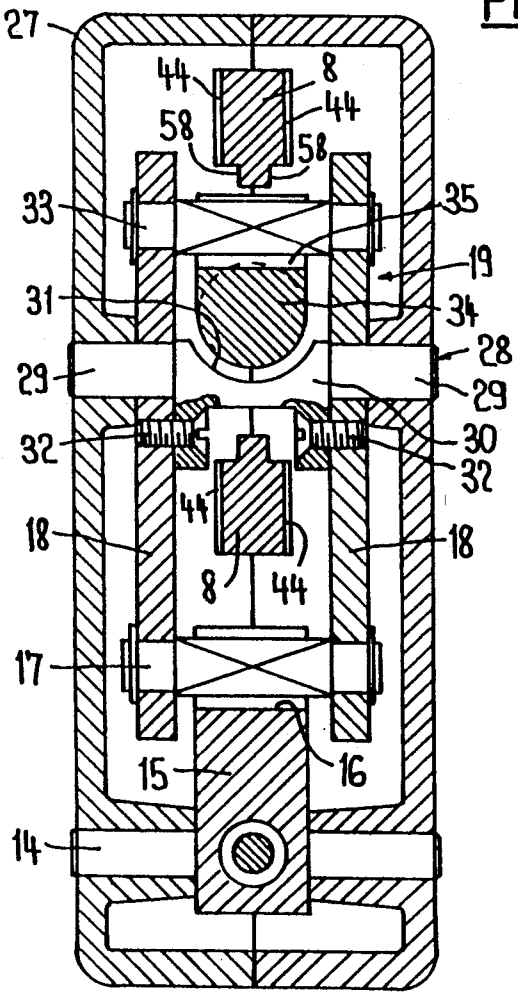
FIG. 2 shows a section of the appliance of FIG. 1 along the line II/II.

The substances to be dispensed may be quite viscous, so that relatively high forces have to be applied in order to extrude them. On the other hand, as precise a proportioning as possible is desired while observing the exact mixing ratio of the dispensed substances, so that the overall requirements for the mechanical components of such an appliance are high, for on one hand, the advance must be easy-running and must not be jammed when great forces are applied, and on the other hand, it must be precise in order to avoid any relative displacement of the rams. Dispensing pistons 6 disposed in the cartridges (see FIG. 7) are actuated by thrust pieces 7 at the ends of rams 8. These rams are driven via a lever assembly and a thrust member by trigger 3. Trigger 3 is linked with a pivot piece 9 which,. is pivotably beared on pin 10 and connection to articulated joint 11, the two parts of which are hinged together by axle 12 and the second part 13 of which is attached to hinge 15 rotating on hinge bolt 14. Hinge 15 itself acts onto a bolt 17 which runs freely in cutout 16 and which is disposed at the lower end (with respect to FIGS. 1 and 2) of thrust lever 19 formed of two plates 18. It appears from FIG. 1 and 4 that upon actuation of trigger 3, articulated joint 11 is lifted in the direction of arrow 20 under the pressure of return spring 21, which is secured to link 11 on one side, and to pin 22 on the other. An excursion of the articulated joint 11 will cause a deflection of the hinge and hence of the lower end of thrust lever 19 in the direction of arrow 23. Articulation 11 and hinge 15 together effect a reduction of the deflection of thrust lever 19, which allows an increase of its thrust, on one hand, and a precise control of the advance on the other. The ratio of mechanical advantage or reduction, respectively, may be adjusted in different ways and manners, e.g. by exchanging the trigger, by displacing the axle of articulation 11 or, as shown in the present example, by continuous variation of the distance between the axle 12 of articulated joint 11 and the pin 14 of hinge 15. This is achieved by displacing the second part 13 of articulated joint 11 inside the bore 24 of hinge 15 by means of an adjusting screw 25 which extends in a corresponding thread of articulation 13. This adjusting screw is accessible for adjustment through an opening 26 of housing 27. It is possible by a combination of the proposed measures to adjust the reduction ratio e.g. within a range of 7.5:1 to 25:1.

Thrust lever 19 is journalled on main axle 28, which is disposed in two-part housing 27. Main bearing 28 consists of two bearing pins 29 which are inserted in the thrust lever plates 18 and run in the housing parts of housing 27, and of a bearing piece 30 which is provided with a recess 31 for the passage of thrust member 34 and elongated downwardly in order to receive screws 32 linking the bearing piece to the thrust lever plates 18. The force from the trigger is transmitted by several levers to hinge 15, from there to bolt 17 of thrust lever 19 and by bolt 33 to thrust member 34, bolt 33 being arranged in a milling 35 of thrust member 34, as appears in FIGS. 1 and 2. On the side of the cartridges, thrust member 34 is guided in a cylindrical sliding guide 56 and in clamping jaw arrangement 36 (see also FIG. 3), and on the other side, in a sliding guide 37, whereby a parallel advance of the thrust member free from shearing forces is ensured. The cylindrical sliding guide 37 is arranged in housing 27. At the end of thrust member 34, which runs in sliding guide 37, a proportioning screw 38 is fitted which allows limitation of the thrust piston stroke, whereby proportioning may be adjusted precisely.

Figure 3:
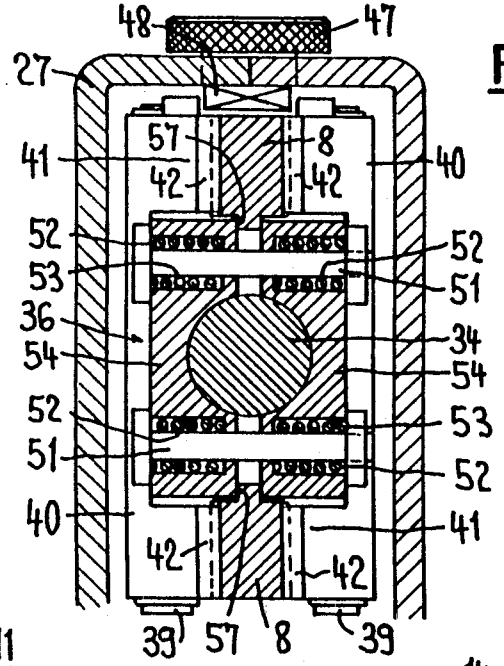
FIG. 3 shows a section along the line III/III of FIG. 1.

In the thickened central part of the thrust member 34, as appears in particular in FIGS. 1, 3, and 6, two ratchet axles 39 are inserted, around each of which a respective ratchet 40 is arranged. Each ratchet 40 is U-shaped (see FIG. 1), the short shanks 41 on the side of the cartridge being provided with a thrust pawl 42. The shanks 41, respectively pawls 42 are pressed against each other by means of a compression spring 43 disposed at the other end of the ratchet. The force is transmitted from the trigger via articulations and thrust lever to thrust member 34, and from there by ratchet axles 39 to ratchets 40 and, hence, to pawls 42, and from there, to rams 8. Rams 8 have on both sides, i.e. in front and at the back in FIG. 1, an indentation 44 in which pawls 42 engage in order to move ram 8 forwards, i.e. towards cartridge 4. Rams 8 are guided on the side of the cartridge and at the back of housing 27, and they are provided with a hole 46 at the rear connecting part 45 in order to allow retracting the ram to its starting position. To this end, the ratchets, respectively pawls have to disengage, which is effected by knurled screw 47 which upon rotation pivots the ratchets and removes pawls 44 from the rams. The set screw is provided with a snap arrangement consisting of a ball 49 under pressure of a spring 50, in order to lock the set screw in an engaged or released position.

At the moment the advancing movement stops, i.e. when the trigger is released, it should be avoided that the rams are retracted with the pawls, on one hand, and on the other hand, any afterflow of the substance should be prevented. In order to solve these problems, clamping jaw arrangement 36 has two axles 51 on each of which two pressure springs 52 are provided (see FIG. 3) which are lodged in a corresponding recess 53 of the two clamping jaws 54 and press the clamping jaws against each other. The force of the pressure springs is chosen such as to compress the clamping jaws just enough to hold the piston during return of the ratchets. To avoid an afterflow of the substances from nozzle 5, it is sufficient to relieve the extrusion pistons somewhat, i.e. to retract the rams by a small amount. This is effected in that a certain pressure is exerted onto clamping jaws 54 by means of pressure reduction springs 55 which rest on the guide 56 on the side of the cartridge. According to FIG. 3, inner edges 57 of the clamping jaws act directly onto rams 8, which are provided with corresponding millings 58 on their insides. The clamping jaws can only recede a small distance which is limited by a stop.

Figures 7, 8, 9, 10:
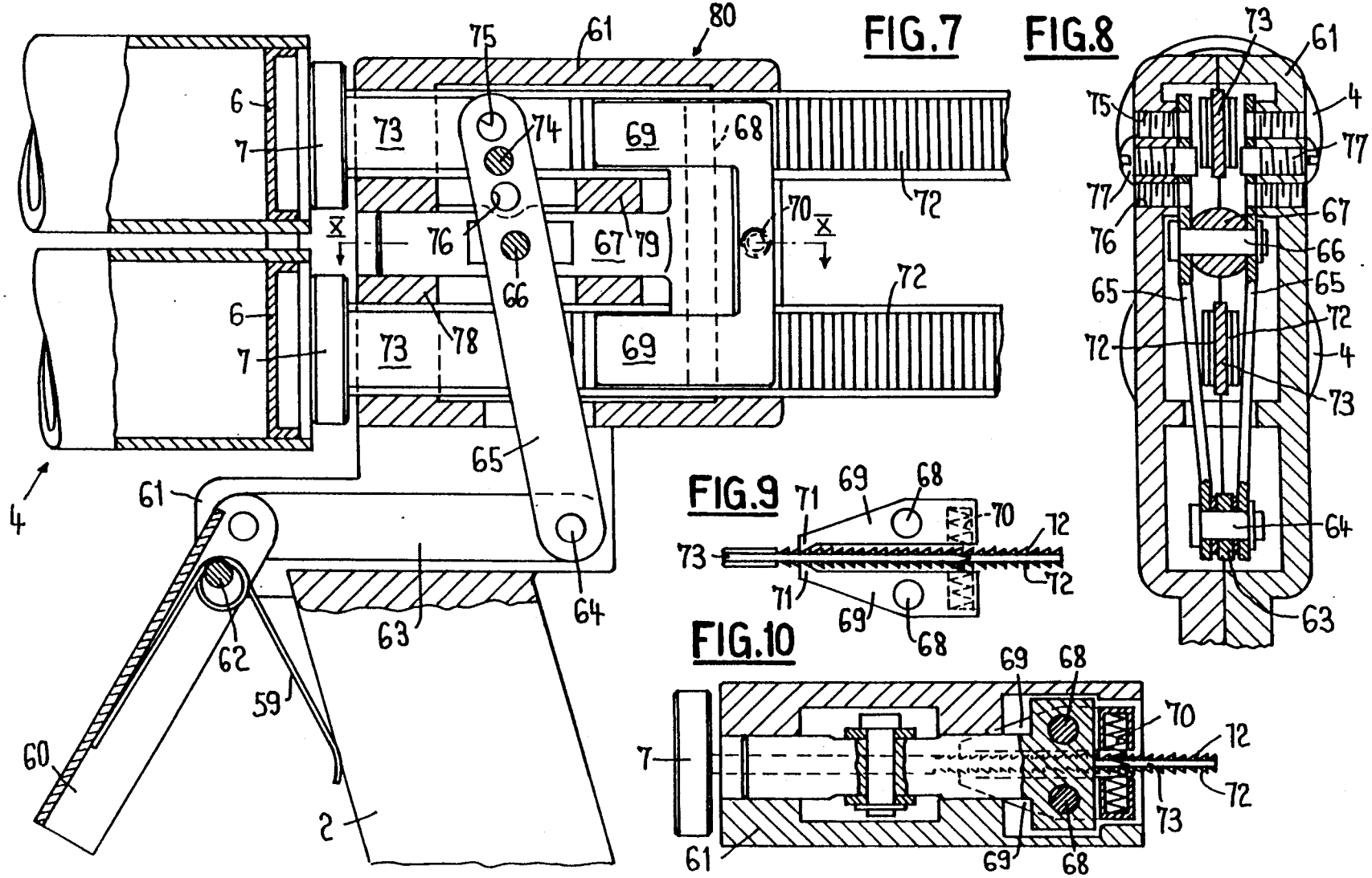
FIG. 7 shows a second embodiment of a manually operated appliance according to the invention.
FIG. 8 shows a section through the appliance of FIG. 7.
FIG. 9 shows an enlarged detail of the appliance of FIG. 7.
FIG. 10 shows a section along the line X/X in FIG. 7.

FIGS. 7 to 10 represent a second embodiment wherein force transmission is effected according to the same principle, but the ratchets are pulled instead of being pushed. Trigger 60 is shown under pressure of spring 59, pivotable around axle 62 mounted in housing 61 and connected to traction tab 63. This traction tab 63 is movably attached to two traction levers 65 over an axle 64 (see FIG. 8). In the upper third, approximately, the two traction levers 65 are attached to each other by a traction bolt 66 which engages in the central part of thrust member 67 in order to push it in the direction of cartridges 4. As in the previous example, thrust member 67 is provided with two ratchet axles 68 around each of which a ratchet 69 is pivotably disposed under pressure of springs 70. Advance pawls 71 engage in indentations 72 of rams 73, these rams having a substantially thinner conformation than in the previous embodiment. As mentioned above, the ratchets are not pushed but pulled as they are placed behind the traction lever. The gear, respectively reduction ratio between trigger stroke and thrust member stroke may be varied by displacement of pivot point 74 in choosing either the center hole, as shown in FIG. 7, or the hole below, 75, or above, 76. The pivot point is fixed by the two screws 77 (see FIG. 8). Execution of the remaining parts of the manually operated appliance, such as the clamping jaws, thrust member guides 78 and 79 as well as the end part for retraction of the rams is similar to that of the first embodiment and adapted to this one.

Figure 11:
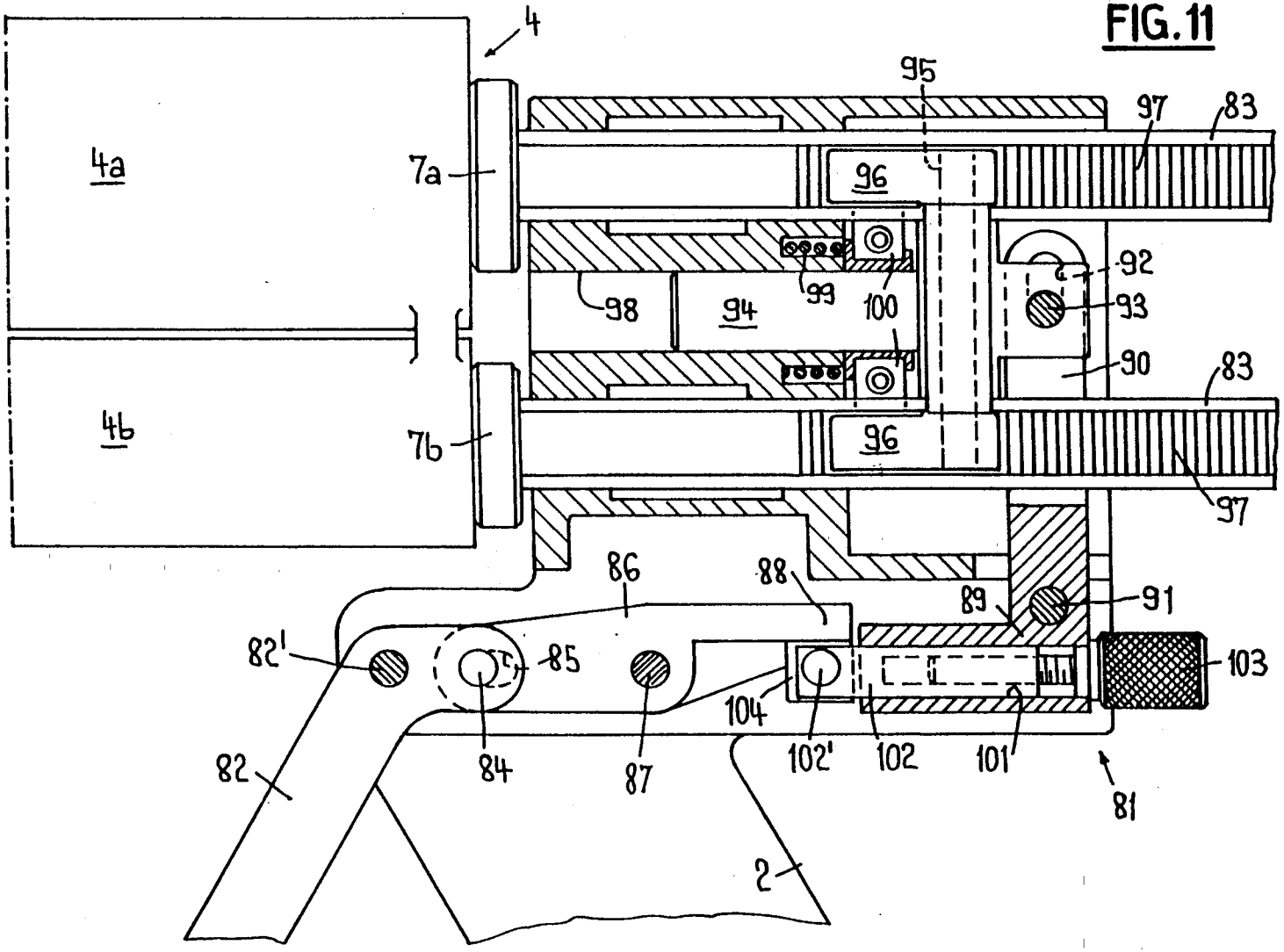
FIG. 11 shows a third embodiment of a manually operated appliance according to the invention.

The third embodiment of appliance 81 is represented in FIG. 11, only the differing parts being schematically shown. In this embodiment, force transmission from trigger 82 to rams 83 has a different configuration than in the previous ones. Trigger 82 is pivotably beared on pin 82' and is provided at its angled front end with a bolt 84 which is disposed in an oblong hole 85 of lever 86, which in turn is hinged on axle 87. When the trigger is pulled against handle 2, its end including bolt 84 is lifted and projection 88 of lever 86 is lowered and presses on angled shank 89 of thrust lever 90, the upper end of which is moved in the direction of cartridges 4. Thrust lever 90 is hinged on pin 91 and provided at its upper end with an oblong hole 92 in which an axle 93 is disposed which passes through thrust member 94. The thrust member is connected, as in the previous examples, to four ratchets 96 by ratchet axles 95, the ratchet pawls being engaged in indentations 97 of the rams and advancing them. In this embodiment, thrust member 94 is guided by a long cylindrical sliding guide 98 in which pressure relief springs 99 acting onto clamping jaws 100 are disposed. The clamping jaw assembly is substantially the same as in the first embodiment according to FIG. 3.

In FIG. 11, it is shown by way of example that the individual cartridges of the double cartridge need not necessarily have the same diameter, respectively volume, as a ram is assigned to each cartridge. In this example, cartridge 4*a* shows a greater diameter than cartridge 4*b*, and accordingly, the diameter of thrust piece 7*a* is greater than that of thrust piece 7*b*. Of course, this applies to all embodiments.

In this embodiment, reduction is effected by variation of the bearing point of projection 88 on leg 89 of thrust lever 90. For this purpose, a longitudinal bore 101 is provided in leg 89, in which a slide piece 102 is lengthwise displaceably disposed by means of set screw 103. On the end opposite the set screw, a contact piece 104 pivoting around axle 102' is secured to slide piece 102, resulting in a clearly defined contact point when projection 88 bears down on it. The contact point may be displaced by means of the set screw in order to adjust leverage and, accordingly, reduction.

Figure 12:
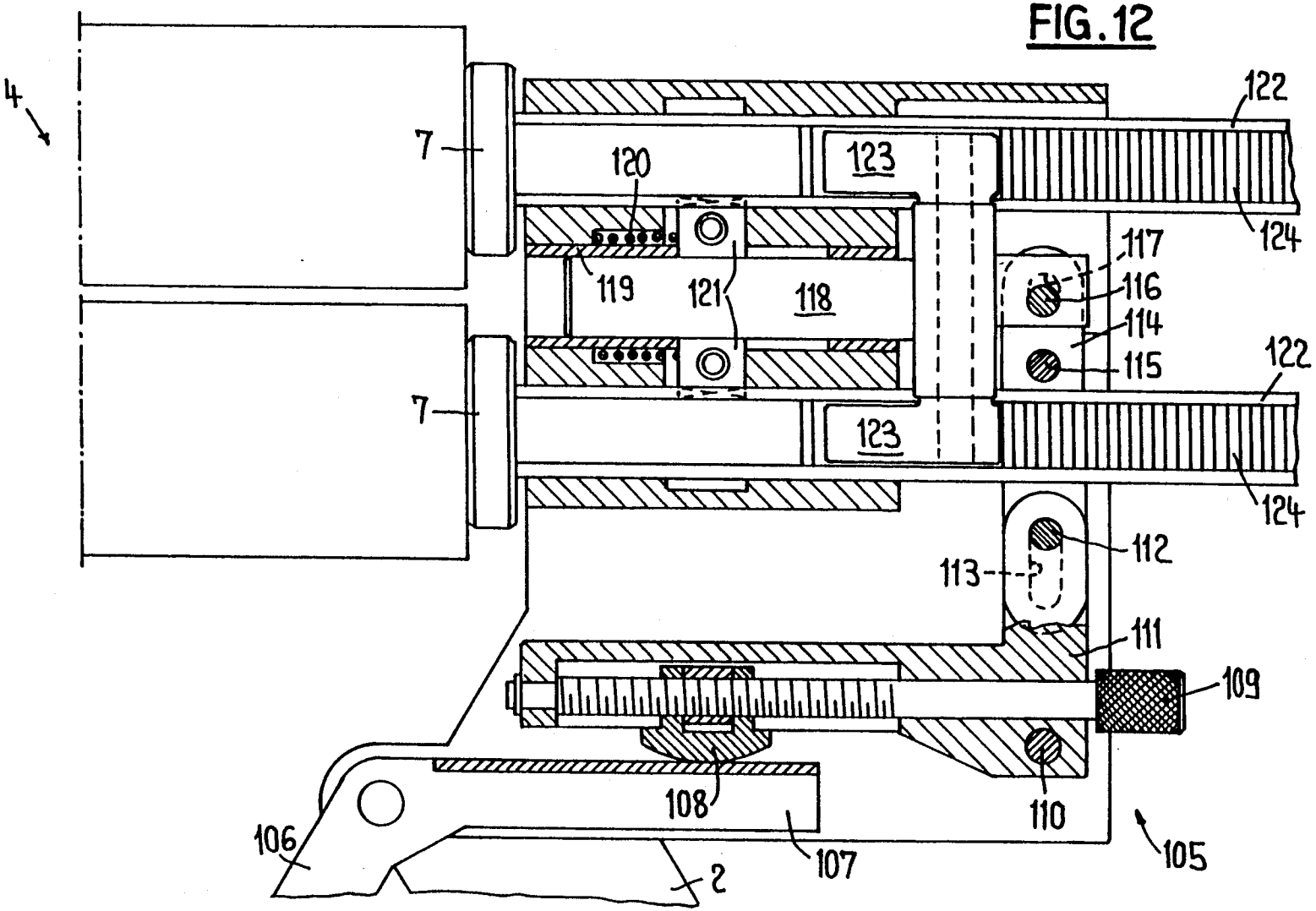
FIG. 12 shows a fourth embodiment of a manually operated appliance according to the invention.

In the fourth embodiment according to FIG. 12 an appliance of similar configuration to that of FIG. 11 is illustrated wherein another force transmission arrangement is indicated. As opposed to other embodiments, trigger 106 features a relatively long angled leg 107 actuating a displaceable, rounded bearing piece 108 disposed on a set screw 109. Set screw 109 is fitted in a leg of angled lever 110 journalled on axle 110 the other leg of which receives a bolt 112 cooperating with an oblong hole 113 of thrust member 114 in order to pivot the latter around pivot pin 115, whereby thrust bolt 116 is advanced in the direction of the cartridges. Thrust bolt 116 is disposed in an oblong bore 117 of thrust member 118. Of course, in this case as well as in the previous examples, force transmission from axles and bolts to holes and recesses is reversible or may be effected in other ways. In analogy to the previous example, thrust member 118 is guided in cylindrical sliding guides 119 containing pressure relief springs 120 which act onto clamping jaw arrangement 121 and thus onto rams 122. In previously described manner, thrust member 118 is linked to ratchets 123 which advance the rams by means of the pawls, the ratchet pawls engaging ram indentations 124.

Figure 14:
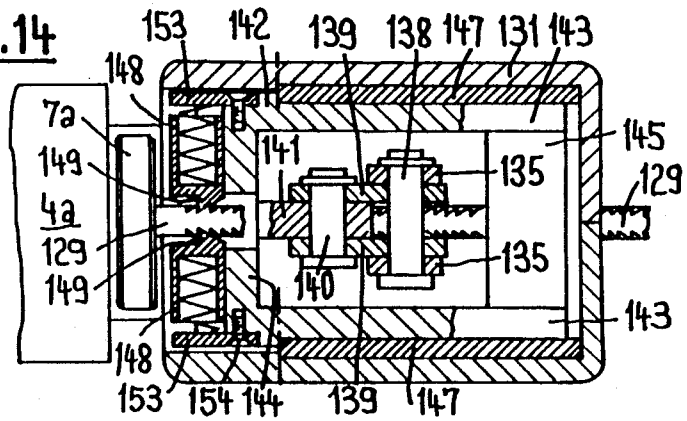
FIG. 14 shows a section along the line XIV/XIV of FIG. 13.
Figure 15:
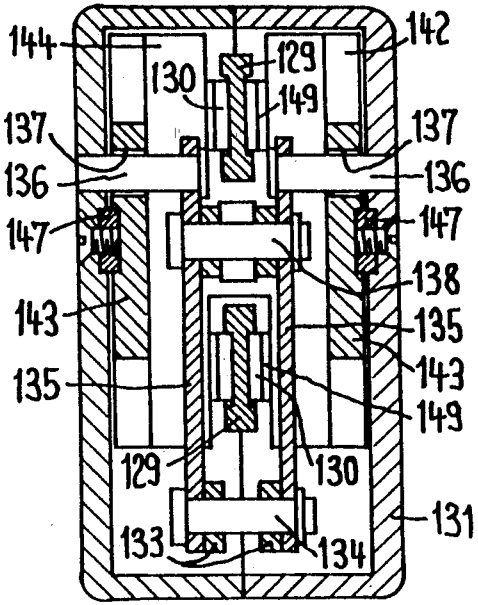
FIG. 15 shows a section along the line XV/XV of FIG. 13.
Figure 13:
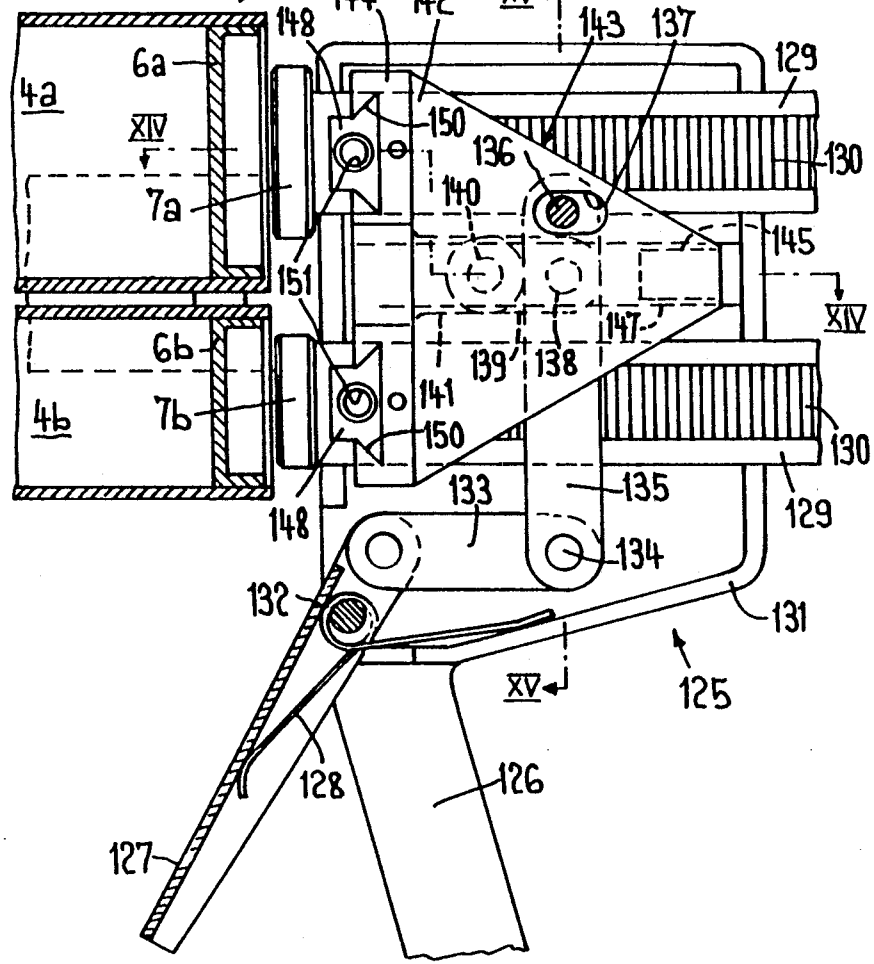
FIG. 13 shows a fifth embodiment of a manually operated appliance according to the invention.

As opposed to the previous embodiments, the thrust member of the fifth embodiment according to FIGS. 13 to 15 is not guided in between the rams but in the housing. FIG. 13 shows a part of appliance 125 having a handle 126, trigger 127 and return spring 128 as well as a double cartridge 4 having a thicker cartridge 4*a* and a thinner cartridge 4*b*, and dispensing pistons 6*a* and 6*b* actuated by thrust pieces 7*a* and 7*b* of rams 129 with indentations 130. Trigger 127 is pivotable around axle 132 attached to two-part housing 131 and movably connected to two traction tabs 133 which in turn are linked to two thrust levers 135 via an axle 134. The thrust levers are pivotable around fixed axle 136 inserted in the housing. The two thrust levers 135 are connected to each other below fixed axle 136 by bolt 138 which acts onto a freely movable, short, two part articulated joint 139, provided at the other end with another bolt 140 which connects the two parts of the articulation. Bolt 140 extends in an eye 141 arranged on slide member 142.

Thrust member 142 essentially consists of two triangular side plates 143 (see FIG. 13) which are connected to each other both on the cartridge side by a front wall 144 and on the other side by a web 145 in order to give a rigid frame, and which have each an oblong hole 137 for receiving axle 136. The eye 141 is placed at the front side 144, see FIG. 14. According to FIG. 15, the two side plates 143 are guided in the two side walls 146 of housing 131. Moreover, guides 147 attached on the inside of the housing side walls may be formed of plastics material or also of bronze, while the side parts of the thrust member may be formed of aluminium, for example.

In order to transmit the force from the trigger to rams 129, on either side of each ram a respective spring-loaded pawl holder 148 is attached to the cartridge side of thrust member 142, a thrust pawl 149 being provided at the ends of said pawl holders facing the rams (see FIG. 14). FIG. 13 illustrates that pawl holder 148 has the configuration of a dovetail key which runs in a corresponding dovetail groove 150. Each pawl holder 148 has a dead bore 151 in which a pressure spring 152 is lodged in order to press the pawl into indentations 130 of the ram. On one side, the spring rests on the floor of bore 151, and on the other, on a cover plate 153 which is secured to the sides 143 of the thrust member by means of screw 154. The height of the pawl holder is thereby smaller than the distance between the plate and the pawl tip in order to allow upward and downward gliding of the pawl holder. The pawl holder need not be dovetailed; it may have any other form allowing anchorage in the thrust member, as e.g. A T-shaped or rounded configuration.

Figures 16, 17:
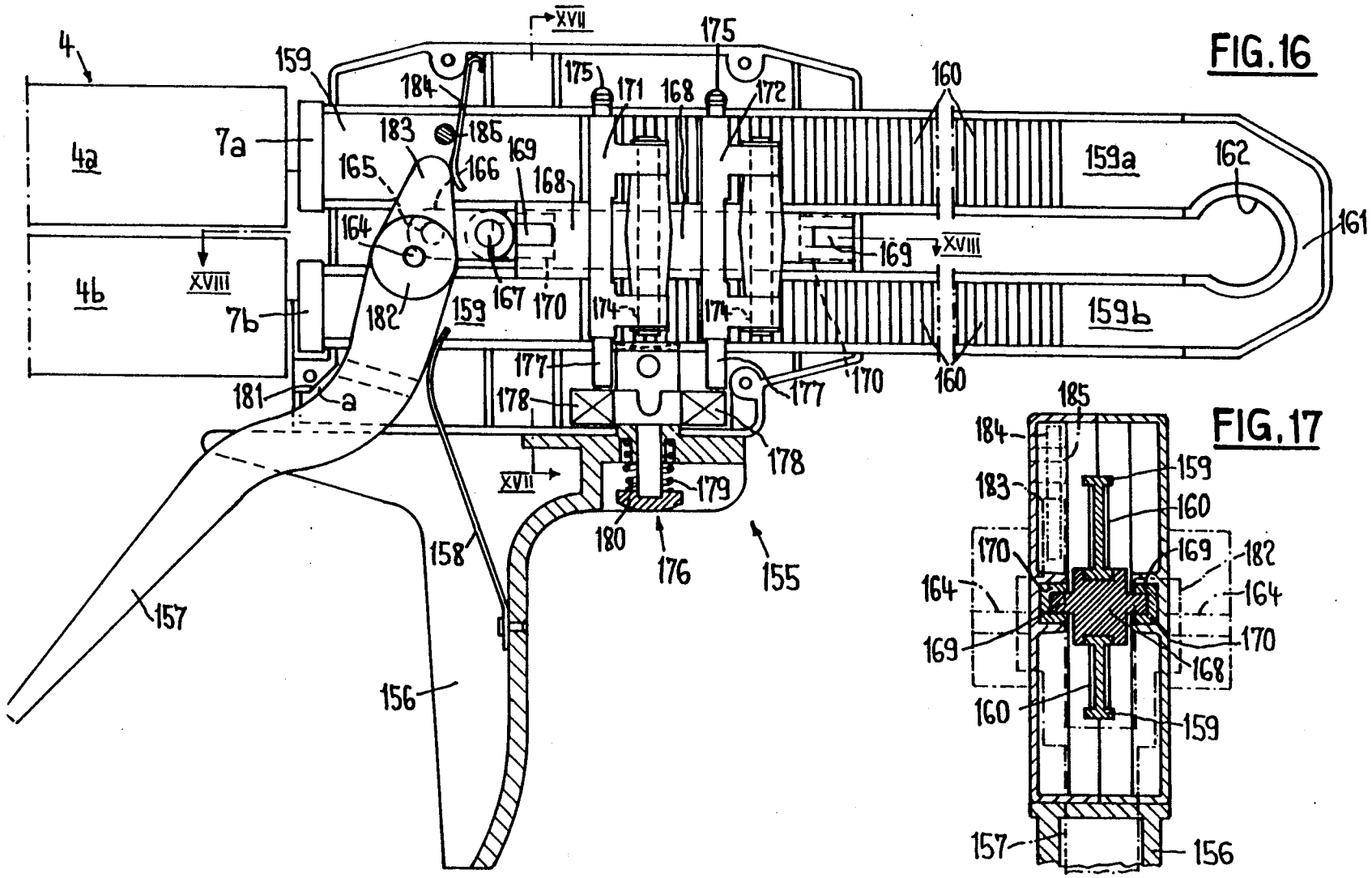
FIG. 16 shows a sixth, preferred embodiment of a manually operated appliance according to the invention.
FIG. 17 shows a section along the line XVII—XVII of FIG. 16.

The manually operated appliance 155 described in FIGS. 16 to 19 is a preferred embodiment of a dispensing appliance the construction of which is simple and which is simple to produce yet works precisely. The manually operated appliance 155 is derived from the previous embodiment according to FIGS. 13 to 15, wherein the thrust member is guided in the housing and not between the rams. In FIG. 16 appears a portion of manually operated appliance 155 including handle 156; trigger 157 with return leaf spring 158, as well as double cartridge 4 with thicker cartridge 4*a* and thinner cartridge 4*b* and the two dispensing pistons (not shown actuated by thrust pieces 7*a* and 7*b* of rams 159 with indentations 160. The two rams are connected to each other by a crosspiece 161 having an opening 162 for a finger, and they may suitably be made from an appropriate plastics material. FIG. 16 further shows that ram 159*a* is wider than ram 159*b*.

Figure 18:
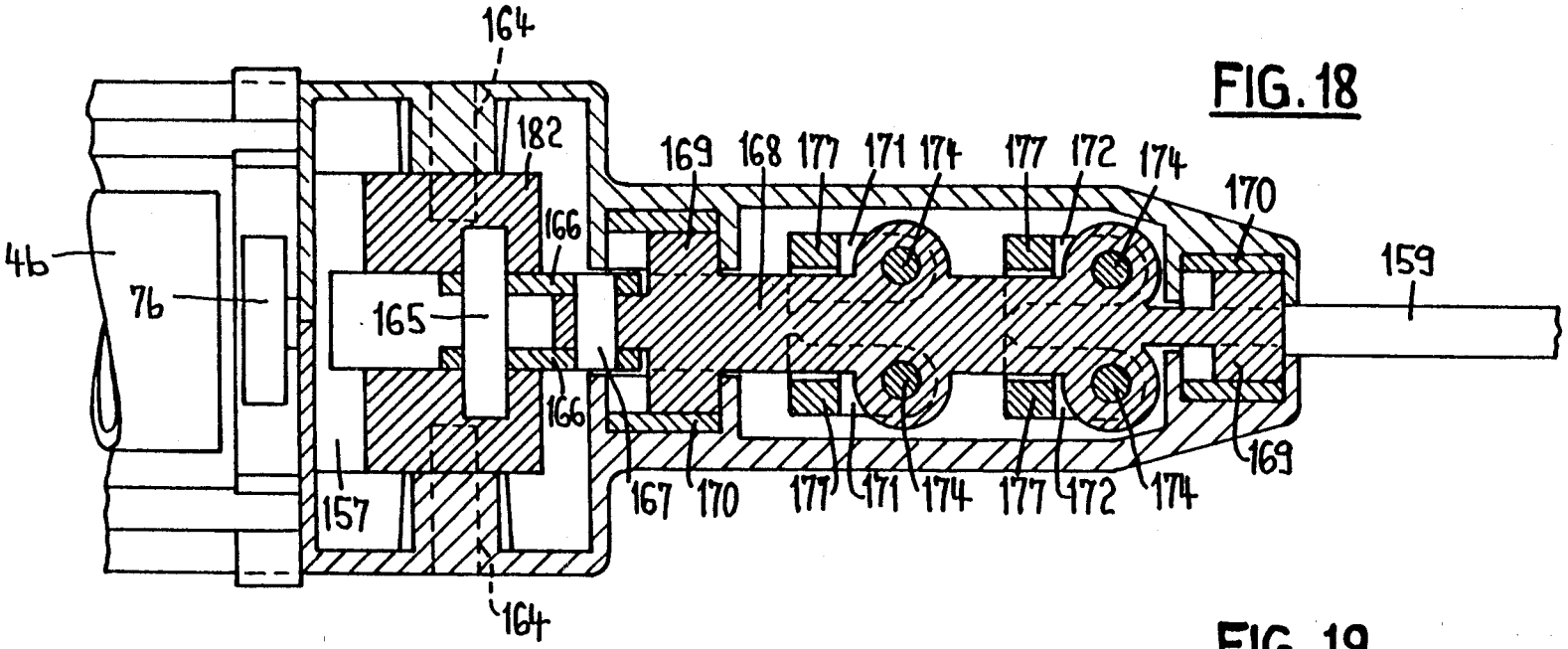
FIG. 18 shows a section along the line XVIII—XVIII of FIG. 16.

Trigger 157 is hinged on axle 164 which is journalled in the two-part housing, and provided with an eye 182 which is movably connected by an axle 165 to two traction tabs 166 which in turn are linked by an axle 167 to thrust member 168, see also FIG. 18. As appears especially in FIG. 17, the thrust member comprises two ribs 169 which are guided in corresponding guides 170 provided in both housing walls. The ribs and the corresponding guides thereby do not extend over the entire thrust member but only over a certain portion of the end of the thrust member on the cartridge side and at the rear end of the housing. The thrust member, in this embodiment, is drawn by the trigger.

Figure 19:
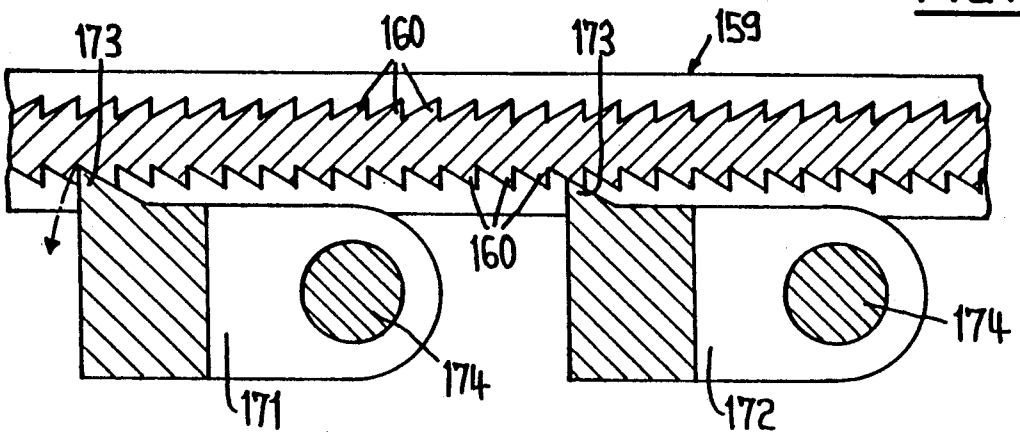
FIG. 19 shows a detail of the manually operated appliance according to FIG. 16.

As opposed to the previous embodiments, the force from the trigger is alternatingly transmitted to rams 159 by two pairs of ratchets 171 and 172, i.e. the thrust member is provided with two spring-loaded ratchets 171, respectively 172 which are disposed on both sides of each ram and which comprise a thrust pawl on their ends facing the rams, see also FIG. 19. In particular, FIG. 19 also shows that the two pairs of ratchets are arranged at such a mutual distance that one respective pawl is always in engagement with the rams 159 in a position which is offset by half a tooth length of the indentations 160. This also means that only one respective pair of pawls engages the indentations of the rams. This offset arrangement allows an increased precision of the advance. Each of the pairs of ratchets is hinged on an axle 74, and the ratchets which are arranged on either side of the rams are connected to each other by a spring 175 in order to engage the pawls. As in the previous examples, releasing device 176 allows swinging out the pawls and thus, retracting the rams. For this purpose, the respective pawls are linked by a connecting piece 177, said connecting piece projecting from the ratchet axle in order to be lifted by conical displacer 178 which is actuated by a push-button subjected to the pressure of spring 179. Since there are two pairs of ratchets in the present example, the releasing device correspondingly has a symmetrical configuration with push-button 180 being adapted to displace both pairs of connecting pieces.

Now, if trigger 157 bears directly against edge 181 of the housing, it will be very difficult to actuate release button 180. In order to facilitate operation of this button, a projection 183 is provided at the eye 182 of the trigger, said projection being subjected to the pressure of leaf spring 184 and its movement being limited by a stop 185. Leaf spring 184 is stronger than return leaf spring 158 and results in a clearance a being created between edge 181 and the corresponding portion of the trigger, whereby releasing of the pawls is facilitated. Instead of securing the leaf spring to the housing, as represented in FIG. 16, it is also possible to attach it directly to the projection and to use a housing rib as an abutment.

It is as well possible in these embodiments to provide a clamping jaw arrangement for relief of the thrust member operating in analogy to the previous examples, and likewise, to conceive adjustable advantage gear means between the trigger and the thrust member.

It follows from the various embodiments, which may be combined and certain details of which may have a different configuration, that the force impact upon the rams is always parallel to these rams and acts exactly in the direction of the longitudinal axes of the cartridges, and that no shearing forces are exerted upon these rams. The entire force from the trigger is applied exactly in the direction of the cartridge axes as the thrust members are guided over a long distance. Moreover, the different reduction and proportioning possibilities allow exact proportioning without any afterflow.

The schematically illustrated cartridges do not always have to be cartridges of the same diameter and it is also possible to conceive such a force transmission from the thrust member to the rams that different forces are applied to the latter. Further, force transmission may be effected by other means than axles and bolts cooperating with cutouts or the like.

Moreover, it is evident that the various characteristic features of the embodiments may be mutually exchanged and combined with each other.

What I claim is:

1. A manually operated appliance for dispensing respective materials from two cartridges, which comprises:

a housing for supporting the cartridges, the cartridges having respective axes substantially parallel to each other, the housing having sidewalls;

a respective thrust ram for each cartridge, each thrust ram being mounted in the housing for movement in a first direction toward and coaxial with its cartridge and each thrust ram having first and second sides extending parallel to the first direction;

drive means for advancing the thrust rams in their respective first directions;

a movable trigger for actuating the drive means in response to movement of the trigger; and the drive means including a thrust member movable in parallel to the first direction of the thrust rams in response to movement of the trigger, means for guiding the movement of the thrust member such that thrust member moves parallel to the first directions substantially without any shearing forces being applied thereto and means responsive to the thrust member for transmitting thrust forces to the first and second sides of each thrust ram so that the thrust rams move in their respective first directions substantially without any shearing forces being applied thereof.

2. A manually operated appliance according to claim 1, wherein said means for guiding comprises a cylindrical guide disposed between said rams.

3. A manually operated appliance according to claim 1, wherein said thrust member is held by sliding guides which are attached to the side walls of the housing of said manually operated appliance.

4. A manually operated appliance according to claim 1, wherein the advance of said rams is effected by an indentation of said rams on each of said opposed sides.

5. A manually operated appliance according to claim 1, wherein the means for transmitting the thrust forces from said thrust member to said rams includes spring-loaded ratchets, said ratchets cooperating with said thrust member and being adapted to be moved forward together with said thrust member in order to advance said rams in the first direction.

6. A manually operated appliance according to claim 1, wherein the means for transmitting thrust forces from said thrust member to said rams includes, pawls which are disposed on one end of spring-loaded pawl holders, said pawl holders being slidably attached to said thrust member and adapted to be moved forward together with said thrust member in order to advance said rams in the first direction.

7. A manually operated appliance according to claim 1, wherein it further comprises a clamping jaw arrangement having spring-loaded clamping jaws, in order to hold said thrust member in its umimpacted condition, and pressure relief springs, in order to retract said rams via said clamping jaws for a certain amount to create a suckback of said materials.

8. A manually operated appliance according to claim 1, wherein the cartridges include respective dispensing pistons and the rams include respective thrust pieces engageable respectively with the dispensing pistons, the cartridges, the dispensing pistons and the thrust pieces each being circular, and the diameters of the cartridges, the dispensing pistons and of the thrust pieces of said rams, as well as the width of the rams, being different from each other.

9. A manually operated appliance for dispensing respective materials from two cartridges, which comprises:

a housing for supporting the cartridges, the cartridges having respective axes substantially parallel to each other, the housing having sidewalls;

a respective thrust ram for each cartridge, each thrust ram being mounted in the housing for movement in each direction toward and coaxial with its cartridge and each thrust ram having first and second sides extending parallel to the first direction;

drive means for advancing the thrust rams in their respective first directions;

a movable trigger for actuating the drive means in response to movement of the trigger; and the drive means including a thrust member movable parallel to the first directions of the thrust rams in response to movement of the trigger, means for guiding the movement of the thrust member and means responsive to the thrust member for transmitting thrust forces from the thrust member to the rams to move the rams in the first direction, said thrust member being provided with two side plates disposed on either side of said rams, said side plates being connected to each other by a front wall on the cartridge side and by a web on the other side in a box-like manner.

10. A manually operated appliance for dispensing respective materials from two cartridges, which comprises:

a housing for supporting the cartridges, the cartridges having respective axes substantially parallel to each other, the housing having sidewalls;

a respective thrust ram for each cartridge, each thrust ram being mounted in the housing for movement in a first direction toward and coaxial with its cartridge and each thrust ram having first and second sides extending parallel to the first direction;

drive means for advancing the thrust rams in their respective first directions;

a movable trigger for actuating the drive means in response to movement of the trigger; and the drive means including a thrust member movable parallel to the first directions of the thrust rams in response to movement of the trigger, means for guiding the movement of the thrust member and means responsive to the thrust member for transmitting thrust forces from the thrust member to the rams to move the rams in the first direction, the means for transmitting thrust forces including a U-shaped ratchet opposite the first sides of said rams, and a U-shaped ratchet opposite the second sides of said rams, each U-shaped ratchet including two shanks, each shank being provided with a pawl intended for one of said rams, said ratchets being pivotably mounted on a ratchet axle each, said ratchet axles cooperating with the thrust member such as to be moved forward together with said thrust member in order to advance said rams in the first direction.

11. A manually operated appliance according to claim 10, wherein between said two U-shaped ratchets, a rectangular release axle is disposed which is operable by means of a set screw adapted to snap into different positions.

12. A manually operated appliance according to claim 10, further including a return leaf spring for returning the trigger to its initial position after actuation thereof, and a second spring for acting upon an upper end of said trigger in order to keep the latter at a small distance from an edge of said housing and thereby to facilitate release of said pawls.

13. A manually operated appliance for dispensing respective materials from two cartridges, which comprises:

a housing for supporting the cartridges, the cartridges having respective axes substantially parallel to each other, the housing having sidewalls;

a respective thrust ram for each cartridge, each thrust ram being mounted in the housing for movement in a first direction toward and coaxial with its cartridge and each thrust ram having first and second sides extending parallel to the first direction;

drive means for advancing the thrust rams in their respective first directions;

a movable trigger for actuating the drive means in response to movement of the trigger; and the drive means including a thrust member movable parallel to the first directions of the thrust rams in response to movement of the trigger, means for guiding the movement of the thrust member and means responsive to the thrust member for transmitting thrust forces from the thrust member to the rams to move the rams in the first direction, the means for transmitting thrust forces including two respective pairs of ratchets having spring-loaded ratchet axles connecting each respective pair of ratchets to said thrust member, one pair of ratchets being disposed opposite the first sides of said rams and the other pair being disposed opposite the second sides, and the two ratchet axles of one side being arranged at a mutual distance which corresponds to an integer number of ram teeth plus half a length thereof.

14. A manually operated appliance according to claim 13, wherein said ratchets are adapted to be released by a ratchet releasing device by means of a button, a displacer acting upon projecting portions of said two ratchet axles.

15. A manually operated appliance for dispensing respective materials from two cartridges, which comprises:

a housing for supporting the cartridges, the cartridges having respective axes substantially parallel to each other, the housing having sidewalls;

a respective thrust ram for each cartridge, each thrust ram being mounted in the housing for movement in a first direction toward and coaxial with its cartridge and each thrust ram having first and second sides extending parallel to the first direction;

drive means for advancing the thrust rams in their respective first directions;

a movable trigger for actuating the drive means in response to movement of the trigger; and the drive means including a thrust member movable parallel to the first directions of the thrust rams in response to movement of the trigger, means for guiding the movement of the thrust member and means responsive to the thrust member for transmitting thrust forces from the thrust member to the rams to move the rams in the first direction, adjustable and displaceable gear elements being disposed between said trigger and a thrust lever.

16. A manually operated appliance for dispensing respective materials from two cartridges, which comprises:

a housing for supporting the cartridges, the cartridges having respective axes substantially parallel to each other, the housing having sidewalls;

a respective thrust ram for each cartridge, each thrust ram being mounted in the housing for movement in a first direction toward and coaxial with its cartridge and each thrust ram having first and second sides extending parallel to the first direction;

drive means for advancing the thrust rams in their respective first directions;

a movable trigger for actuating the drive means in response to movement of the trigger; and the drive means including a thrust member movable parallel to the first directions of the thrust rams in response to movement of the trigger, means for guiding the movement of the thrust member and means responsive to the thrust member for transmitting thrust forces from the thrust member to the rams to move the rams in the first direction, said trigger being movably connected to two traction tabs which in turn are movably linked to said thrust member, sadi thrust member being guided in guides at opposite ends of said housing.

17. A manually operated appliance for dispensing respective materials from two cartridges, which comprises:

a housing for supporting the cartridges, the cartridges having respective axes substantially parallel to each other, the housing having sidewalls;

a respective thrust ram for each cartridge, each thrust ram being mounted in the housing for movement in a first direction toward and coaxial with its cartridge and each thrust ram having first and second sides extending parallel to the first direction;

drive means for advancing the thrust rams in their respective first directions;

a movable trigger for actuating the drive means in response to movement of the trigger; and the drive means including a thrust member movable parallel to the first directions of the thrust rams in response to movement of the trigger, means for guiding the movement of the thrust member and means responsive to the thrust member for transmitting thrust forces from the thrust member to the rams to move the rams in the first direction, a pivotably journalled thrust lever, said trigger being connected by a pivot piece and an articulated joint to a hinge having a free cutout end which actuates a bolt disposed at one end of said thrust lever, and the other end of which is provided with a bolt that cooperates with said thrust member, said articulated joint being submitted to the pressure of a return spring, said articulated joint and sadi hinge each having respective pivots, the distance between the axle of said joint and the axle of said hinge being continuously adjustable by means of a set screw for variation of the mechanical gear ratio.

18. A manually operated appliance for dispensing respective materials from two cartridges, which comprises:

a housing for supporting the cartridges, the cartridges having respective axes substantially parallel to each other, the housing having sidewalls;

a respective thrust ram for each cartridge, each thrust ram being mounted in the housing for movement in a first direction toward and coaxial with its cartridge and each thrust ram having first and second sides extending parallel to the first direction;

drive means for advancing the thrust rams in their respective first directions;

a movable trigger for actuating the drive means in response to movement of the trigger; and the drive means including a thrust member movable parallel to the first directions of the thrust rams in response to movement of the trigger, means for guiding the movement of the thrust member and means responsive to the thrust member for transmitting thrust forces from the thrust member to the rams to move the rams in the first direction, said trigger being movably attached to one end of a traction tab which in turn is movably linked at its other end two traction levers disposed on either side of the thrust member and connected to each other by a traction bolt which cooperates with said thrust member, the end of said traction levers opposite said traction tab having a number of holes for pivot point adjustment of said traction levers.

19. A manually operated appliance for dispensing respective materials from two cartridges, which comprises:

a housing for supporting the cartridges, the cartridges having respective axes substantially parallel to each other, the housing having sidewalls;

a respective thrust ram for each cartridge, each thrust ram being mounted in the housing for movement in a first direction toward and coaxial with its cartridge and each thrust ram having first and second sides extending parallel to the first direction;

drive means for advancing the thrust rams in their respective first directions;

a movable trigger for actuating the drive means in response to movement of the trigger; and the drive means including a thrust member movable parallel to the first directions of the thrust rams in response to movement of the trigger, means for guiding the movement of the thrust member and means responsive to the thrust member for transmitting thrust forces from the thrust member to the rams to move the rams in the first direction, said trigger being angled and connected to one end of a first lever, the other end of which actuates a leg of an angled thrust lever which cooperates with the thrust member, variation of the ratio movement of the trigger to corresponding movement of the first thrust member being obtained by displacement of the contact point of the other end of said first lever with a contact piece of said thrust lever which is adjustable by means of a set screw.

20. A manually operated appliance for dispensing respective materials from two cartridges, which comprises:

a housing for supporting the cartridges, the cartridges having respective axes substantially parallel to each other, the housing having sidewalls;

a respective thrust ram for each cartridge, each thrust ram being mounted in the housing for movement in a first direction toward and coaxial with its cartridge and each thrust ram having first and second sides extending parallel to the first direction;

drive means for advancing the thrust rams in their respective first directions;

a movable trigger for actuating the drive means in response to movement of the trigger; and the drive means including a thrust member movable parallel to the first directions of the thrust rams in response to movement of the trigger, means for guiding the movement of the thrust member and means responsive to the thrust member for transmitting thrust forces from the thrust member to the rams to move the rams in the first direction, said trigger comprising an angled leg actuating a leg of an angled lever which is movably connected to a thrust lever acting onto said thrust member, a bearing piece which is continuously adjustable by means of a set screw being provided on the leg of said angled lever.

21. A manually operated appliance for dispensing respective materials from two cartridges, which comprises:

a housing for supporting the cartridges, the cartridges having respective axes substantially parallel to each other, the housing having sidewalls;

a respective thrust ram for each cartridge, each thrust ram being mounted in the housing for movement in a first direction toward and coaxial with its cartridge and each thrust ram having first and second sides extending parallel to the first direction;

drive means for advancing the thrust rams in their respective first directions;

a movable trigger for actuating the drive means in response to movement of the trigger; and the drive means including a thrust member movable parallel to the first directions of the thrust rams in response to movement of the trigger, means for guiding the movement of the thrust member and means responsive to the thrust member for transmitting thrust forces from the thrust member to the rams to move the rams in the first direction, said trigger being springloaded and being connected to two parallelly disposed, movably journalled traction tabs which in turn are linked with two thrust levers disposed on either side of said rams, said thrust levers being pivotable on an axle inserted in said housing and actuating one end of an articulated joint by a bolt and said articulated joint being provided at its other end with a second bolt extending in an eye disposed at the front side of said thrust member.

22. A manually operated appliance for dispensing respective materials from two cartridges, which comprises:

a housing for supporting the cartridges, the cartridges having respective axes substantially parallel to each other, the housing having sidewalls;

a respective thrust ram for each cartridge, each thrust ram being mounted in the housing for movement in a first direction toward and coaxial with its cartridge and each thrust ram having first and second sides extending parallel to the first direction;

drive means for advancing the thrust rams in their respective first directions;

a movable trigger for actuating the drive means in response to movement of the trigger; and the drive means including a thrust member movable parallel to the first directions of the thrust rams in response to movement of the trigger, means for guiding the movement of the thrust member and means, including pawls disposed in pawl holders, responsive to the thrust member for transmitting thrust forces from the thrust member to the rams to move the rams in the first direction, said pawl holders being slidably disposed in a slide member by dovetail joints, and respective pressure springs being lodged inside a dead bore of said holder and resting on a cover which is removably secured to said thrust member.

* * * * *